US005261567A

United States Patent [19]

Krall

[11] Patent Number: 5,261,567

[45] Date of Patent: Nov. 16, 1993

[54] SQUEEZE PACKAGE WHICH CAN BE INVERTED TO DISPENSE LIQUIDS

[75] Inventor: Thomas J. Krall, Toledo, Ohio

[73] Assignee: Owens-Illinois Plastic Products Inc., Toledo, Ohio

[21] Appl. No.: 997,159

[22] Filed: Dec. 22, 1992

Related U.S. Application Data

[63] Continuation of Ser. No. 779,700, Oct. 21, 1991, abandoned.

[51] Int. Cl.[5] ..... B65D 39/00

[52] U.S. Cl. ..... 222/153; 222/212; 222/499; 222/559; 222/563

[58] Field of Search ..... 222/149, 151, 153, 212, 222/491, 492, 495, 499, 522, 559, 552, 563

[56] References Cited

U.S. PATENT DOCUMENTS

| | | | |
|---|---|---|---|
| 1,126,040 | 1/1915 | Lilly | 222/563 X |
| 2,179,423 | 11/1939 | Pari | 222/552 X |
| 2,931,543 | 4/1960 | Thomas | 222/559 X |
| 4,749,103 | 6/1988 | Barriac | 222/153 X |
| 4,930,668 | 6/1990 | Krall | 222/212 |

FOREIGN PATENT DOCUMENTS

| | | | |
|---|---|---|---|
| 675549 | 12/1963 | Canada | 222/492 |
| 189116 | 2/1957 | Fed. Rep. of Germany | 222/522 |
| 977419 | 4/1951 | France | 222/492 |
| 2578806 | 9/1986 | France | 222/495 |
| 797790 | 7/1958 | United Kingdom | 222/495 |

*Primary Examiner*—Andres Kashnikow
*Assistant Examiner*—Kenneth Bomberg

[57] ABSTRACT

A squeeze package such as a toilet bowl cleaner bottle comprising a plastic container having an open neck defining a first opening, a second laterally extended opening on the neck defining a second opening and a closure mounted on the neck and movable from a first position and includes a portion extending into said first opening and providing a seal isolating the second opening from the contents of the container to a second position wherein the seal moves out of position so that the contents can be dispensed through the second opening by inverting the container and squeezing the container. In one form, the closure comprises a child resistant closure that is associated with portion of the neck so that the closure must to oriented circumferentially to permit the closure to be moved axially outwardly to expose the second opening.

4 Claims, 3 Drawing Sheets

SQUEEZE PACKAGE WHICH CAN BE INVERTED TO DISPENSE LIQUIDS

This is a continuation of copending application(s) Ser. No. 07/779,700 filed on Oct. 21, 1991 now abandoned.

This invention relates to squeeze containers and particularly to squeeze containers with child resistant closures.

BACKGROUND AND SUMMARY OF THE INVENTION

In dispensing liquid from packages comprising a squeeze bottle and closure, such as packages containing toilet bowl cleaning liquids, it is desirable to be able to invert the container in order to direct the liquids. In one type of package, the container is provided with an angled neck and a fitment closing the neck with a closure removably mounted on the neck. In order to dispense the contents, the closure is removed and the bottle is inverted and squeezed to direct the liquid out of the fitment in the desired direction. Such a construction of an angled neck requires either a special process or a multi-process which adds substantially to the cost of manufacture. Further, the filling of a container having an angled neck requires modified filling lines which further adds to the cost of the package. The requirement for both a dispensing fitment or nozzle and a closure also adds to the cost.

Among the objectives of the present invention are to provide a squeeze package system for dispensing liquids in a desired direction which is materially lower in cost; has lower filling costs; and does not require any special fitment or nozzle.

In accordance with the invention, the squeeze package comprises a plastic container having an open neck defining a first opening, a second laterally extended opening on the neck defining a second opening and a closure mounted on the neck and movable from a first position and includes a portion extending into said first opening and providing a seal isolating the second opening from the contents of the container to a second position wherein the seal moves out of position so that the contents can be dispensed through the second opening by inverting the container and squeezing the container. In one form, the closure comprises a child resistant closure that is associated with portion of the neck so that the closure must to oriented circumferentially to permit the closure to be moved axially outwardly to expose the second opening.

DESCRIPTION

Figure 1:
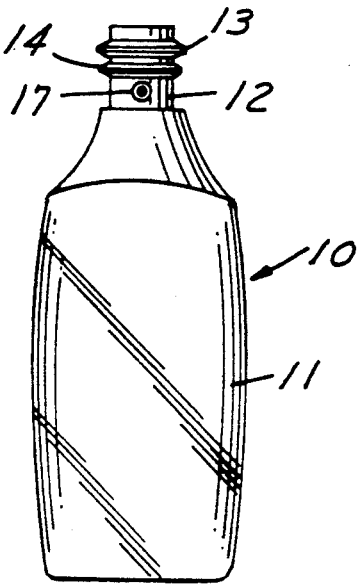
FIG. 1 is an elevational view of a squeeze package embodying the invention.
Figure 2:
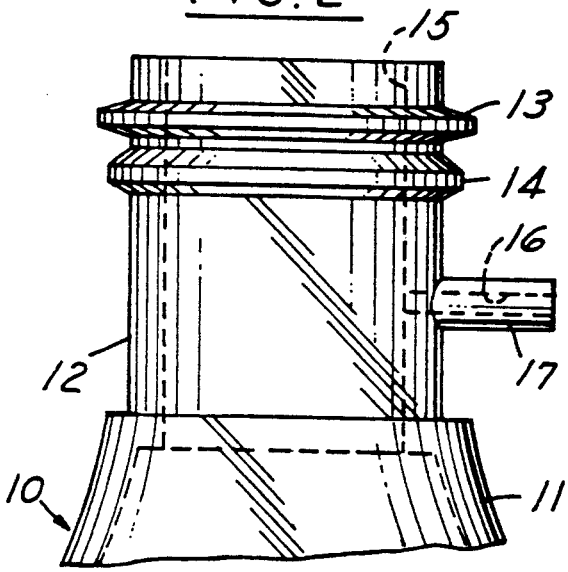
FIG. 2 is a fragmentary view on an enlarged scale of a portion of the package.
Figure 3:
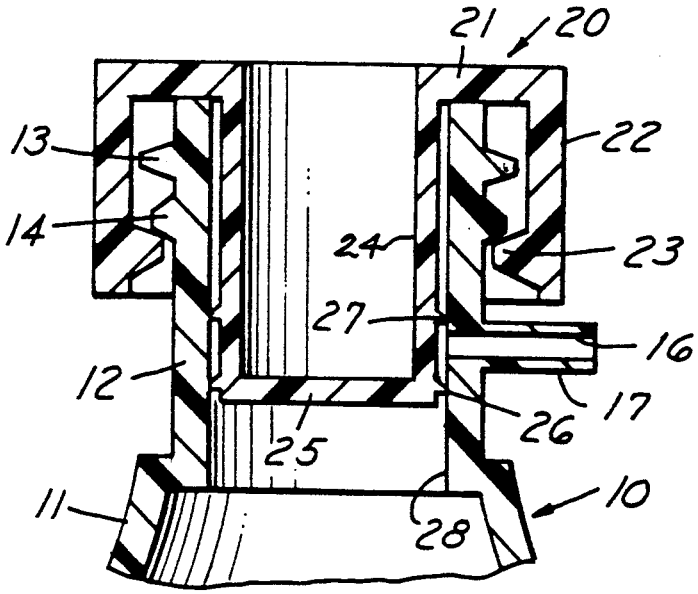
FIG. 3 is a fragmentary sectional view.

Referring to FIGS. 1-5, the squeeze package embodying the invention comprises a hollow container 10 of plastic material such as high density polyethylene including a body portion and a neck 12 that has a pair of annular beads 13, 14, the upper bead 13 nearest the outlet of a opening 15 of the neck 12 having a greater diameter than the lower bead 14. A second opening 16 is defined by an integral tubular portion that extends laterally, preferably at 90° to the axis of the neck 12.

A closure 20 of plastic material such as polypropylene is provided that includes a top wall 21, a peripheral skirt 22 and a radially inwardly extending bead 23 that normally is positioned below the lower bead 14. The closure 20 further includes an integral hollow plug portion 24 defining a cylinder having a closed bottom wall 25. The cylindrical portion 24 includes a flexible lower seal 26 and a vertically spaced flexible upper seal 27. Seals 26, 27 extend radially outwardly and preferably have an asymmetrical triangular cross section that engages the inner surface 28 of the neck 12. When the closure 20 is on the container, the lower seal 26 isolates the opening 16 from the contents of the container 11 and the upper seal 27 isolates the interior of the dispensing tube 17 from the upper portion of the closure 20.

Figure 4:
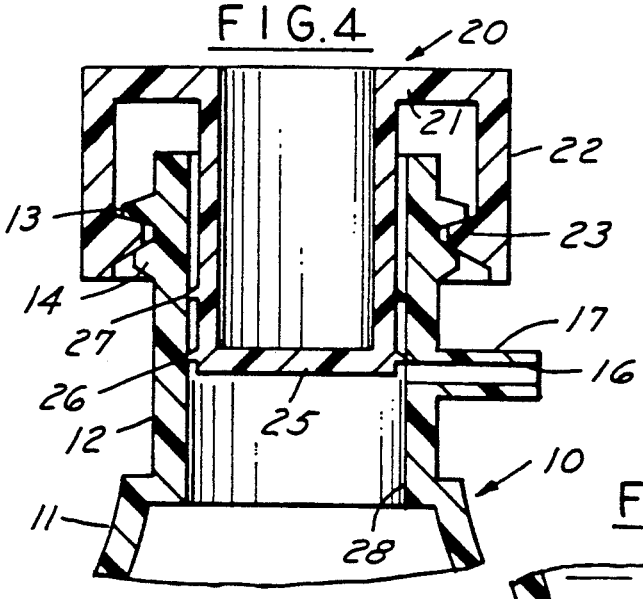
FIG. 4 is a sectional view similar to FIG. 3 showing the package in open position.
Figure 5:
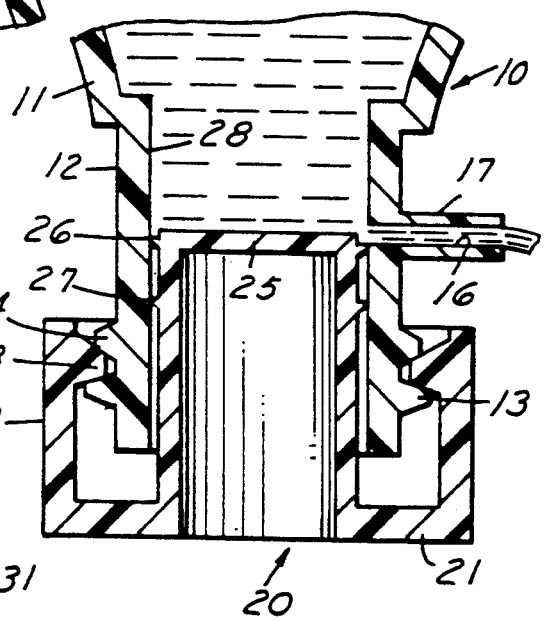
FIG. 5 is a fragmentary sectional view showing the package in inverted dispensing position.

In order to dispense the contents, the closure 20 is moved vertically upwardly in the direction of the arrow shown in FIG. 4, to bring the bead 23 on the closure into position snapped between the lower bead 14 and the upper bead 13 of the neck 11. The package is then inverted and squeezing of the wall body portion 11 of the container will dispense the liquid in any desired direction by aiming the tubular portion 17 in the proper direction.

Figure 6:
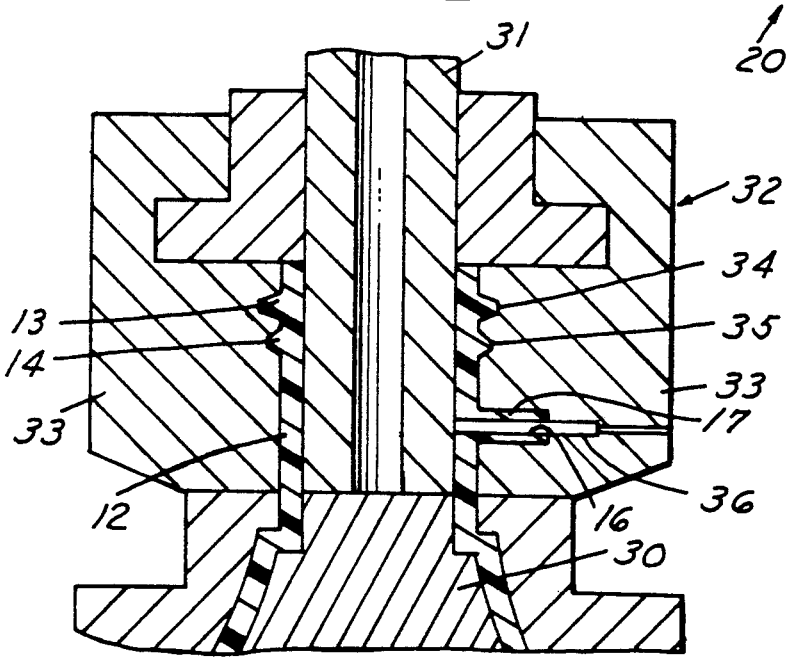
FIG. 6 is a fragmentary sectional view of an apparatus for molding the container.

As shown in FIG. 6, the finish of the container is preferably formed by injection molding plastic from an extruder die head 30 into a space defined by a mold core 31 and a split neck ring 32 wherein the neck ring sections 33 includes annular cavities 34, 35 for the beads 13, 14 and one of the neck ring sections 33 also includes a cavity forming the tube 17 with a secondary core pin 36 spaced to form the cavity for the tube 17. The body of the container can be formed thereafter by moving the neck ring 32 axially upwardly relative to the die head 30 and continuing to extrude a tubular plastic to form a parison which is thereafter enclosed in a blow mold and blow molded to form the container integrally with the neck, as is well known in the art and shown for example in U.S. Pat. Nos. 2,710,987 and 3,029,471, incorporated herein by reference.

Figure 7:
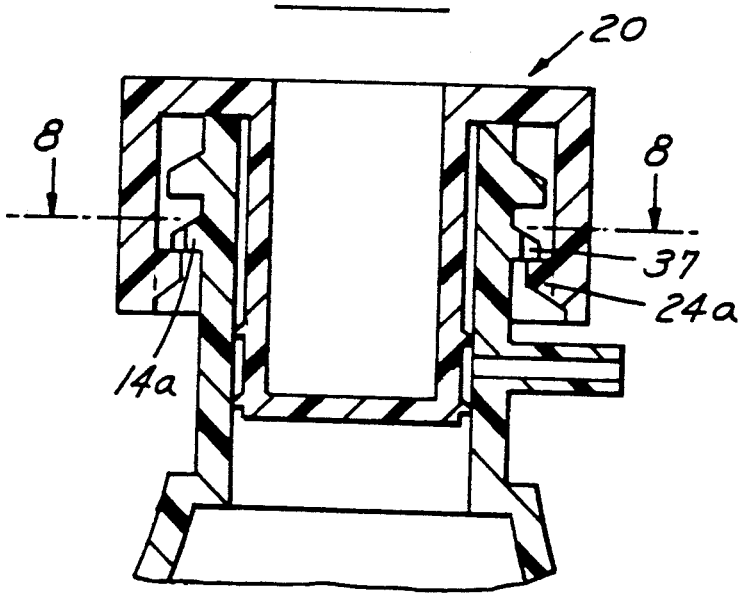
FIG. 7 is a fragmentary sectional view of a child resistant form of the package.
Figure 8:
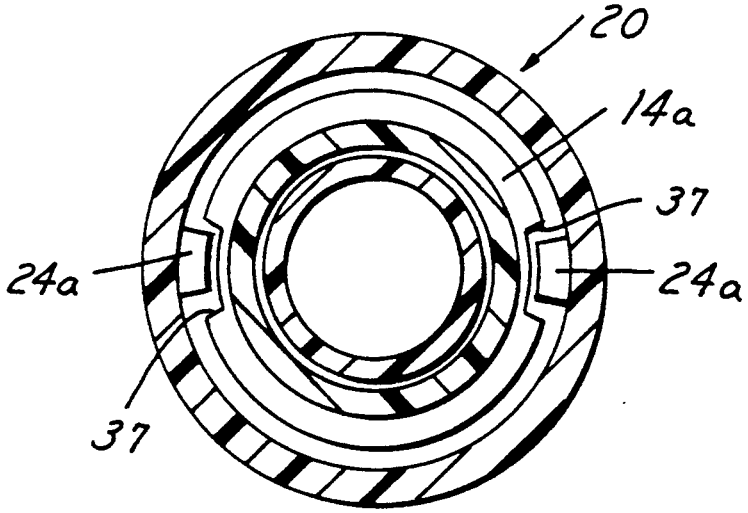
FIG. 8 is a sectional view taken along the line 8—8 in FIG. 7.

In the form shown in FIGS. 7 and 8, a child resistant feature is added wherein the closure **20*a* can not be moved axially without aligning proper portion of the closure and container. In this form, the lower bead 14*a* is provided with diametrically opposed notches 37 and the bead 24*a* on the closure comprises two lugs rather than a continuous bead which must be aligned with the notches in order to permit the closure 20** to be moved axially upwardly. In all other respects, the package is the same.

It can thus be seen that there has been provided a squeeze pump system for dispensing liquids in a desired direction which is materially lower in cost; has lower filling costs; and does not require any special fitment or nozzle.

I claim:

1. A squeeze package comprising a plastic container having an integral open neck defining a first opening, a laterally extended second opening defined by an integral dispensing tube portion on the neck and a plastic closure mounted on the neck and movable between a first position and second position, said closure including a top wall, a peripheral skirt and an integral hollow plug portion defining a cylinder having a closed bottom wall, said plug portion extending axially into said first opening, interengaging means between said neck of said container and said peripheral skirt of said closure operable to hold said closure in said first position and said second position, a first seal supported by said hollow plug portion of said closure isolating the second opening from the contents of the container when said closure is in said first position, a second seal axially spaced from said first seal and supported by said hollow plug portion of said closure isolating the first opening from the container, whereby the first seal is movable by axially moving the closure to said second position such that contents of the container can be dispensed through said second opening by inverting the container and squeezing the container while the first seal isolates the contents of the container from said first opening.

2. The squeeze package set forth in claim 1 wherein said first seal and second seal comprise integral annular seals on said plug portion of said closure which extends into the first opening.

3. The squeeze package set forth in claim 2 wherein said interengaging means between said neck of the container and said peripheral skirt of said closure operable to hold said closure in said first position and said second position comprises interengaging retention bead means on said container and closure.

4. The squeeze package set forth in claim 1 wherein said closure and container includes child-resistant means therebetween constructed and arranged to inhibit movement between said closure and said container unless the closure is properly oriented with respect to said container, said child-resistant means comprising an interrupted bead on one of said container and said closure and at least one lug on the other of said container and said closure.

* * * * *